US006420310B1

(12) United States Patent
Saito et al.

(10) Patent No.: US 6,420,310 B1
(45) Date of Patent: Jul. 16, 2002

(54) THERMAL TRANSFER IMAGE RECEIVING SHEET

(75) Inventors: Hitoshi Saito; Shino Takao; Hirofumi Tomita, all of Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 0 days.

(21) Appl. No.: 09/845,423

(22) Filed: Apr. 30, 2001

Related U.S. Application Data

(62) Division of application No. 08/979,650, filed on Nov. 26, 1997, now Pat. No. 6,300,278.

(30) Foreign Application Priority Data

Nov. 29, 1996 (JP) ..... P08-333083

(51) Int. Cl.[7] ..... B41M 5/035; B41M 5/38
(52) U.S. Cl. ..... 503/227; 438/412
(58) Field of Search ..... 8/471; 428/913, 428/914, 195, 412; 503/227

(56) References Cited

U.S. PATENT DOCUMENTS 4,748,151 A * 5/1988 Murata et al. ..... 503/227
5,362,702 A * 11/1994 Sam et al. ..... 503/227
5,470,817 A * 11/1995 Nakamura et al. ..... 503/227
5,856,268 A * 1/1999 Takeo ..... 503/227

* cited by examiner

*Primary Examiner*—Bruce H. Hess
(74) *Attorney, Agent, or Firm*—Ladas & Parry

(57) ABSTRACT

The present invention provides a thermal transfer image receiving sheet comprising a substrate sheet and a dye receptor layer disposed on at least one surface of the substrate sheet, wherein the dye receptor layer comprises polycarbonate resin of a random copolymer having a main chain which comprises, as essential units, an unit 1 represented by the following formula 1 and an unit 2 represented by the following formula 2, or a polycarbonate resin of a homopolymer which comprises the unit 2, an amount ratio of the unit 1 being not more than 70 mol %, the polycarbonate resin having a Tg of not less than 125° C. and being dissolvable in a general solvent:

FORMULA 1 (UNIT 1)

FORMULA 2 (UNIT 2)

12 Claims, 1 Drawing Sheet

THERMAL TRANSFER IMAGE RECEIVING SHEET

This application is a division of U.S. Ser. No. 08/979,650 filed Nov. 26, 1997, now U.S. Pat. No. 6,300,278, which U.S. application is hereby incorporated herein by reference.

BACKGROUND OF THE INVENTION

1. Field of the Invention

The present invention relates to a thermal transfer image receiving sheet, more specifically to a thermal transfer image receiving sheet, for a thermal transfer printing, which is capable of forming a recording image excellent in color density, sharpness and various toughness, especially in durabilities such as light resistance, fingerprint resistance and plasticizer resistance or the like.

2. Description of the Related Art

Heretofore, various thermal transfer methods have been known. Among these methods, there has been proposed a method wherein a sublimable dye is used as a recording agent and is carried on a substrate sheet such as paper and plastic film to prepare a thermal transfer sheet, and various full color images are formed, by using the thermal transfer sheet, on a thermal transfer image receiving sheet which is capable of being deposited with a sublimable dye, for example, a thermal image receiving sheet having a dye receptor layer on a paper or a plastic film.

In such a case, a thermal head of a printer is used as heating means so that a large number of color dots of three or four colors are transferred onto the thermal transfer image receiving sheet under heating in a very short period of time. As a result, a full color image of an original is reproduced by using the multi-color dots. The thus formed images are very clear or sharp and are excellent in transparency, since the dyes are used therein as a colorant. Accordingly, these images are excellent in half tone reproducibility and gradation characteristic, and are substantially the same as the images formed by the conventional offset printing and gravure printing. Further, when the image forming method mentioned above is carried out, there can be formed images of high quality which are comparable to full color photographic images.

In order to effectively perform the thermal transfer method described above, of course, the structure of the thermal transfer sheet is important. In addition, the structure of the image receiving sheet for forming the image is also important. As examples of the conventional art regarding to the image receiving sheet described above, for example, Japanese Patent Laid-Open Publication Nos. SHO 57-1639370 and SHO 60-25793 disclose a formation of the dye receptor layer onto the substrate sheet by using polyester type resins, vinyl type resins such as polyvinyl chloride resin, polycarbonate resins, polyvinyl butyral type resins, acrylic resins, cellulose type resins, olefin type resins, polystyrene type resin or the like.

In the thermal transfer image receiving sheet described above, dye transferring sensitivity of the dye receptor layer and various durabilities or preserving stability of the thus formed image greatly depend on the resin constituting the dye receptor layer. In particular, light resistance of the formed image greatly depends on an amount ratio and chemical structures of respective resins in a resin composition constituting the receptor layer, so that it is required to select an optimum resin composition. As an example of the resin or resin composition excellent in light resistance, aromatic polycarbonate resin is available. For example, Japanese Patent Laid-Open Publication Nos. SHO 62-169694 and HEI 5-131758 disclose such various aromatic polycarbonate resins.

Further, in order to improve the transferring sensibility of the dye, it is sufficient to improve diffusing property of the dye. As a countermeasure to improve the diffusing property of the dye, there has been proposed various methods, for example, a method in which a resin having a low glass-transition temperature (Tg) is used as the resin constituting the receptor layer, or a method in which a plasticizer is added into the receptor layer. Japanese Patent Laid-Open Publication No. HEI 2-301487 disclose a method of lowering the Tg by copolymerization. Japanese Patent Laid-Open Publication Nos. SHO 60-19138, HEI 2-80291 and SHO 62-202791 disclose a method of improving the dye transferring sensitivity of the aromatic polycarbonate resin by adding the plasticizer or a resin having a low Tg.

However, the prior art techniques described above arise the following problems.

Namely, as to polycarbonate resin derived from 2,2-bis(4-hydroxyphenyl)propane (i.e., bisphenol A) which is deemed to be the most popular and suitable in most of the Official Gazettes of the prior art techniques described above, this resin being composed of only an unit 1 represented by the following formula 1:

FORMULA 1

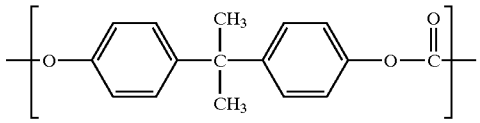

and, as to a copolymer of polycarbonate resin disclosed in Japanese Patent Laid-Open Publication No. HEI 2-301487, these resins have insufficient solubility with respect to solvent. Therefore, when these resins are used for manufacturing the thermal transfer image receiving sheet, it is required to dissolve these resins with the by use of chlorinated solvents such as methylene chloride, trichloromethane or the like, thus resulting in harmful deterioration of working environments for workers.

In contrast, as an example of an aromatic polycarbonate resin having a sufficient solubility and enabling a coating work with the use of non-halogenated type hydrocarbon solvents such as ketone type, toluene type, or mixture-solvent thereof, there has been proposed a polycarbonate resin which is derived from 1,1-bis(4-hydroxyphenyl) cyclohexane (i.e., bisphenol Z), this polycarbonate resin being represented by the following formula 5:

FORMULA 5

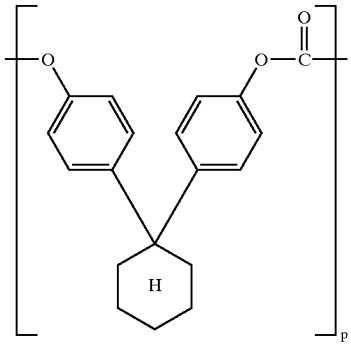

[in formula 5, "p" denotes integer]

and also proposed a polycarbonate resin derived from 2,2-bis(4-hydroxy-3-methylphenyl)propane (i.e., bisphenol C), this resin being composed of only an unit 2 represented by the following formula 2:

FORMULA 2

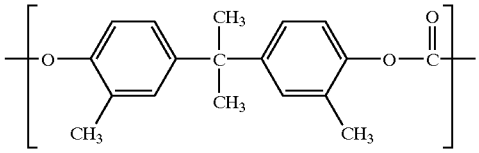

Further, Japanese Patent Laid-Open Publication No. HEI 5-131758 discloses various copolymers of polycarbonate resins each having sufficient solubility.

However, there were caused problems that these easily dissolvable polycarbonate resins are inferior to those derived from bisphenol A in light resistance, or that aromatic dihydroxy compounds to be used as the raw material of the easily dissolvable polycarbonate resins has an industrial disadvantage because they are expensive in comparison with bisphenol A.

In addition, these aromatic polycarbonate resins generally have high glass-transition temperatures (Tg). Therefore, in order to obtain sufficient transferring sensitivity of the dye, there has been considered a method in which aforementioned dihydroxy compound to be used as the raw material is selected and copolymerized with bisphenol A thereby to lower the Tg of the polycarbonate per se, or a method in which the receptor layer is plasticized by further adding the plasticizer or the resin having a low Tg thereby to improve the transferring property and the diffusing property of the dye.

However, when the Tg is lowered by the copolymerization, molecular structure of the polymer is changed, so that an excellent light resistance that are inherent to bisphenol A type polycarbonate resin are liable to be deteriorated. In addition, in order to sufficiently improve the transferring property and diffusivity of the dye, it is required to set the Tg to an extremely low level, so that there may be caused a problem that a fixing property of the dye is deteriorated and blur of image are liable to occur after the printing operation, or a problem of a difficulty in selecting suitable dihydroxy compound capable of being copolymerized with bisphenol A as well as to reduce the material cost.

As another method of improving the transferring property and the diffusing property of the dye, as disclosed in the aforementioned Official Gazette, there has been proposed a method in which the plasticizer or the resin having a low Tg is added into the resin for constituting the receptor layer.

In this method, all of the transferring property, diffusing property and fixing property of the dye can be easily controlled so as to meet with the required levels by adjusting the addition amount of the plasticizer or resin having a low Tg. In particular, in a case of polycarbonate resin having a high Tg (e.x., bisphenol A type has a Tg of about 150° C.), this resin is preferable because the properties of the receptor layer can be controlled in a broader range by adjusting an addition amount of the resin having a low Tg.

However, when physical properties or chemical structures of the plasticizer and the low-Tg resin to be added are not optimum, the compatibility of these compounds with respect to aromatic polycarbonate resin is damaged thereby to arise the following problems.

(1) Namely, after the formation of the dye receptor layer, the plasticizer and the low-Tg resin are bled out with time to change the transferring property and diffusing property of the dye, so that the recording sensitivity will be also changed with time.

In a case where the compatibility is worse, the fixing property of the dye will be insufficient, so that there may be caused a problem that the blur of image will occur during the recording procedure, or there may be a case where the printing operation per se will become impossible due to occurrence of tacks in the dye receptor layer.

(2) Even if there is no abnormal defect at the time of the recording procedure, when the recorded image is preserved, in particular, in a high temperature condition, the recorded image will be blurred due to the bleeding-out of the dye after the recording operation.

These problems are particularly liable to arise when a comparatively large amount of the plasticizer or the low-Tg resin is added.

SUMMARY OF THE INVENTION

An object of the present invention is to substantially eliminate defects or drawbacks encountered in the prior art described above and to provide a thermal transfer image receiving sheet to be used in a thermal transfer printing method using a sublimable dye, the sheet being capable of forming a recording image excellent in color density, sharpness and various toughness, especially in light resistance and also capable of being easily manufactured by utilizing an ordinary coating device and by using a non-halogenated type organic solvents such as ketone type, toluene type, or a mixed solvent thereof.

This and other objects of the present invention can be achieved by providing, in one aspect, a thermal transfer image receiving sheet comprising a substrate sheet and a dye receptor layer disposed on at least one surface of the substrate sheet, wherein the dye receptor layer comprises polycarbonate resin of a random copolymer having a main chain which comprises, as essential units, an unit 1 represented by the following formula 1 and an unit 2 represented by the following formula 2, an amount ratio of the unit 1 being not more than 70 mol % based on a total amount of the unit 1 and the unit 2, the polycarbonate resin having a glass transition temperature of not less than 125° C. and being dissolvable in a general solvent:

FORMULA 1 (UNIT 1)

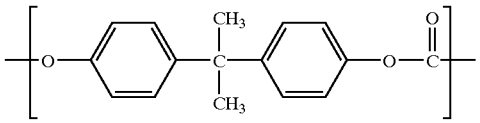

FORMULA 2 (UNIT 2)

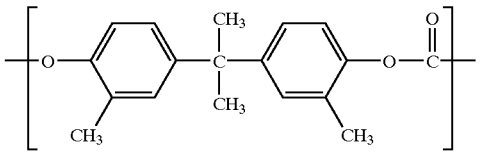

In another aspect of the present invention, there is provided a thermal transfer image receiving sheet comprising a substrate sheet and a dye receptor layer disposed on at least one surface of the substrate sheet, wherein the dye receptor layer comprises (1) polycarbonate resin of a homopolymer having a main chain which comprises an unit 2 represented by the following formula 2 and (2) at least one additive selected from the group consisting of phthalic acid type plasticizers, phosphoric ester type plasticizers, polycaprolactones and polyester plasticizers:

FORMULA 2 (UNIT 2)

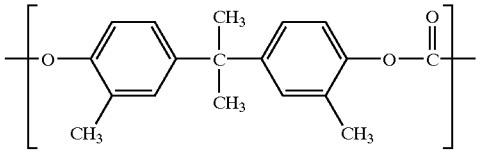

In the respective thermal transfer image receiving sheet as described above, it is preferable to use polycarbonate resin which is dissolvable in a general solvent. It is preferable that the general solvent is a non-halogenated type organic solvent.

Furthermore, it is preferable that the dye receptor layer comprises at least one additive selected from the group consisting of phthalic acid type plasticizers, phosphoric ester type plasticizers, polycaprolactones and polyester plasticizers. Each of these additives preferably has a melting or freezing point of not less than 60° C.

In addition, as the phthalic acid type plasticizer, dicyclohexyl phthalate is preferably used.

Furthermore, it is preferable that the phosphoric ester type plasticizer is at least one compound selected from the group consisting of non-halogenated phosphoric esters and non-halogenated condensed phosphoric esters.

In addition, as the non-halogenated phosphoric ester, it is preferable to use a compound represented by the following formula 3:

FORMULA 3

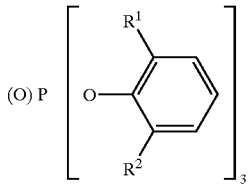

[where each of $R^1$ and $R^2$ denotes hydrogen atom, alkyl group or substituted alkyl group].

In addition, as the non-halogenated condensed phosphoric ester, it is preferable to use a compound represented by the following formula 4:

FORMULA 4

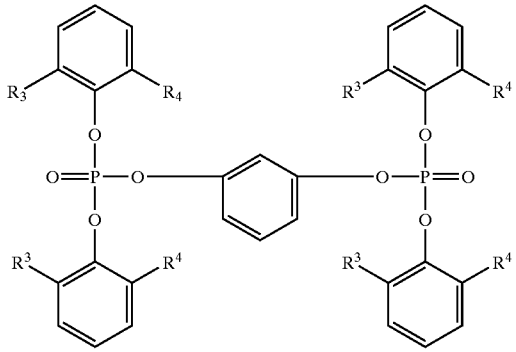

[wherein each of $R^3$ and $R^4$ denotes hydrogen atom, alkyl group or substituted alkyl group].

Still further, it is preferable that the dye receptor layer further comprises aromatic saturated polyester resin.

Furthermore, it is preferable that the dye receptor layer further comprises at least one release agent selected from the group consisting of silicone oils and hardened products of the silicone oils.

In addition, as the hardened product of the silicone oil, it is preferable to use at least one compound selected from the group consisting of hardened products of addition polymerization silicones and hardened products of carbinol-modified silicones hardened with isocyanate compounds.

According to the thermal transfer image receiving sheet having aforementioned structure, the dye receptor layer is formed from the polycarbonate resin having a specified chemical structure as described in the present invention. Therefore, there can be printed images excellent in color density, sharpness or clarity and toughness, particularly in light resistance. In addition, there can be provided a thermal transfer image receiving sheet which can be easily manufactured by using an ordinary coating apparatus in which non-halogenated type organic solvents such as ketone type solvent, toluene type solvent or blended solvent thereof are used.

DESCRIPTION OF THE PREFERRED EMBODIMENTS

Figure 1:
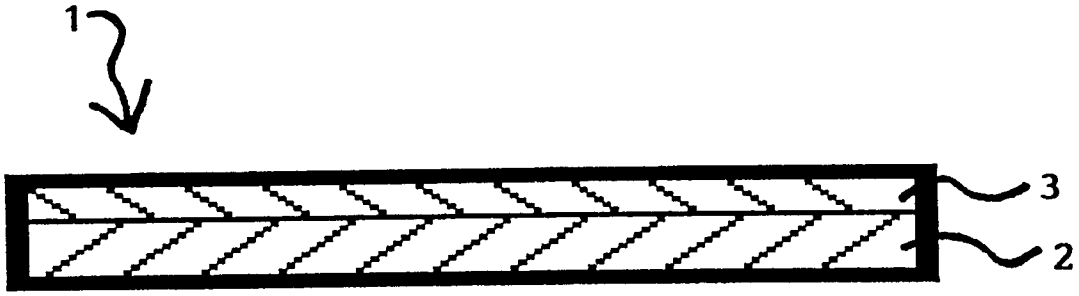
FIG. 1 is a schematic view illustrating a cross section of a thermal transfer image receiving sheet according to the present invention.

The present invention will be made further clear from the following descriptions made with reference to the preferred embodiments.

FIG. 1 is a schematic view of a cross section of one example of a thermal transfer image receiving sheet according to the present invention, in which the thermal transfer image receiving sheet 1 is composed of a substrate sheet 2 and a dye receptor layer 3 disposed on one surface of the substrate sheet.

The thermal transfer image receiving sheet of this invention comprises a substrate sheet and a dye receptor layer disposed on at least one surface of the substrate sheet. Although the substrate sheet to be used in this invention is not particularly limited, there can be used as the substrate sheet, for example, synthetic papers such as polyolefin type, polystyrene type; wood free paper; art paper; coat paper; cast coat paper; wall paper; lining paper; synthetic resin or emulsion impregnated paper; synthetic rubber-latex impregnated paper; synthetic resin lined paper; cellulose fiber paper such as paperboard; various plastic films or sheets such as polyolefin, polyvinyl chloride, polyethylene terephthalate, polystyrene, polymethacrylate, polycarbonate.

In addition, a white opaque film which is formed by adding a white pigment or fillers to the aforementioned synthetic resins, or a foamed film which is formed by foaming operation can be also used as the substrate sheet. Further, a laminated body which is formed by arbitrarily combining a plurality of the aforementioned single-layered sheets composed of above materials can be also used as the substrate sheet. Typical examples of the laminated body may include a laminated body combined cellulose fiber paper with synthetic paper and a laminated body combined cellulose fiber paper with plastic film or sheet.

The thickness of the substrate sheet formed in the manner as mentioned above is optional, but generally in the range of 10 to 300 $\mu$m. In a case where a bonding strength between the substrate sheet and the dye receptor layer to be formed on a surface of the substrate sheet is poor, the surface may preferably be subjected to a primer treatment or a corona discharging treatment.

For the purpose of imparting various properties such as adhesion property, whiteness or brightness, cushioning property, antistatic property, shielding property, anti-curling property or the like, any conventional intermediate layer may be provided between the dye receptor layer and the substrate sheet.

Similarly, for the purpose of imparting, for example, conveying fitness, writing property, pollution resistance, anti-curling property, antistatic property or the like, any conventional back surface layer can be also provided onto a surface reverse to the surface of the substrate sheet to which the dye receptor layer is formed. Further, in order to improve the antistatic property, an antistatic layer containing a conventional antistatic agent may be provided on the dye receptor layer or the back surface layer.

The dye receptor layer to be formed on the surface of the substrate sheet has a function of receiving a sublimable dye migrating or transiting from a thermal transfer sheet and of maintaining the thus formed image. As a resin for forming the dye receptor layer, polycarbonate resin specified above is used. Preferably, the dye receptor layer may contain at least one additive selected from the group consisting of phthalic acid type plasticizers, phosphoric ester type plasticizers, polycaprolactones and polyester plasticizers.

For the purpose of improving the density, sharpness or various preserving properties of a printed image in accordance with the dye contained in the transfer film to be used for the recording procedure, any conventional resin can be also further blended and used as a resin for forming the dye receptor layer. However, when evaluating from the viewpoints of density and preserving properties, aromatic type saturated polyester resin is particularly preferable. Further, a blending ratio of the resin used herein is preferably in the range of 5 to 50 parts by weight based on 100 parts by weight of polycarbonate resin. If the amount of the resin is less than 5 parts by weight, a reforming effect by the addition of the resin hardly appears. On the other hand, if the amount of the resin exceeds 50 parts by weight, the excellent light resistance which is inherent in the polycarbonate resin is damaged.

The polycarbonate resin to be used in this invention can be obtained by an ordinary method in which 2,2-bis(4-hydroxyphenyl)propane (i.e., bisphenol A) and 2,2-bis(4-hydroxy-3-methylphenyl)propane (i.e., bisphenol C) are random-copolymerized to each other.

Further, in this invention, a polycarbonate resin of a homopolymer prepared by polymerizing only bisphenol C can be also used as the material for forming the dye receptor layer.

In addition, a terminal group of the polycarbonate resin is not particularly limited because any termination agents (e.x., phenol type) are available. Therefore, when a hydroxy phenol-type terminator is used, hydroxyl group (OH) is easily introduced into the end group. Further, when cross linking agents such as isocyanate compound are coexisted at the time of forming the dye receptor layer, the cross-linking can be further advanced. By the way, the polycarbonate resin delivered from 2,2-bis(4-hydroxyphenyl)propane (i.e., bisphenol A) is inherently non-soluble with respect to general non-halogenated type organic solvent to be typically represented by non-halogenated hydrocarbon solvent, so that block copolymers are not preferable from the viewpoints of solubility and solution-stability.

Further, in this invention, it is required to use a polycarbonate resin composed of a random copolymer in which at least two kinds of structural units are disorderly linked to each other. On the contrary, a polycarbonate resin composed of a block copolymer in which at least two kinds of specified oligomer chains are linked to each other cannot be used in this invention.

Regarding to a copolymerization ratio of both materials of bisphenols A and C, when a solubility of the materials to non-halogenated organic solvents such as ketone type, toluene type, or a mixture thereof is taken into consideration, an amount of a structural unit derived from bisphenol A is preferably set to 70 mol % or less. When the amount of the unit derived from bisphenol A exceeds 70 mol %, the solubility becomes insufficient, and there may be a possibility of hardly obtaining a sufficient solubility of 10 wt. % or more with respect to the generally available solvents at a normal temperature condition.

In contrast, when the polycarbonate resin of a homopolymer formed by polymerizing only bisphenol C is used as the material for forming the dye receptor layer, the solubility of the resin to the general solvents described above is excellent, so that the resin can be used as the polycarbonate resin in this invention.

When the compatibility of the polycarbonate resin with respect to other resins and solubility to various solvents at the time of the blending operation are taken into consideration, a viscosity-average molecular weight of this polycarbonate resin is preferably in the range of 5,000 to 100,000, more preferably in the range of 10,000 to 50,000.

When the viscosity-average molecular weight of the resin is less than 5,000, the strength of the dye receptor layer to be formed by coating method is insufficient. On the other hand, when the viscosity-average molecular weight exceeds 100,000, a viscosity of a solution prepared by dissolving the resin into the solvent becomes excessively high, so that there resides such a problem that a manufacturing efficiency by utilizing the coating method is disadvantageously lowered, and a problem that solubility is lowered to thereby damage the stability of the resin solution.

In addition, the polycarbonate resin to be used in this invention has a glass transition temperature (Tg) of 125° C. or higher, so that if the polycarbonate resin is singularly used, a sufficient dyeing property can be hardly obtained and a density or sharpness of the image is liable to be poor. Therefore, in order to obtain a sufficient dyeing property without impairing the excellent light resistance which is inherent in the polycarbonate resin, it is preferable to add at least one additive selected from the group consisting of phthalic acid type plasticizers, phosphoric ester type plasticizers, polycaprolactones and polyester type plasticizers to the polycarbonate resin at an amount ranging from 20 to 100 parts by weight, more preferably, 40 to 70 parts by weight based on 100 parts by weight of the polycarbonate resin. If the amount of the additives is less than 20 parts by weight, a sufficient dyeing property cannot be obtained. In contrast, if the amount exceeds 100 parts by weight, the fixing property of the dye may become insufficient, thus causing blurs and stains.

In addition, up to the present, the recording materials specified in this invention are required to have a heat resistance up to 50–60° C. as a market requirement in both conditions of before and after the printing operation, because the recording materials will suffer various heat histories at the time of the product being conveyed or transported before the printing operation, and after the printing operation, the recording materials may be also preserved in various environments with high temperature such as inside of a car in summer.

In this regard, from the viewpoints of preventing a change with time of a recording sensibility before the printing operation and preventing the blur of the image during the preservation thereof after the printing operation, it is preferable that each of the phthalic acid type plasticizers, phosphoric ester type plasticizers, polycaprolactones and polyester type plasticizers has a melting point or a freezing point of not less than 60° C.

From the viewpoints of the requirements described above and preserving properties such as light resistance, dicyclohexyl phthalate (DCHP) is particularly preferable as phthalic acid type plasticizer. In addition, as the phosphoric ester type plasticizer, it is preferable to use non-halogenated phosphoric esters and non-halogenated condensed phosphoric esters represented by the following formulas 3 and 4, respectively:

FORMULA 3

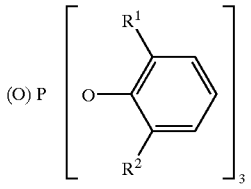

[in formula 3, each of $R^1$ and $R^2$ denotes hydrogen atom, alkyl groups such as methyl group or substituted alkyl group]; and

FORMULA 4

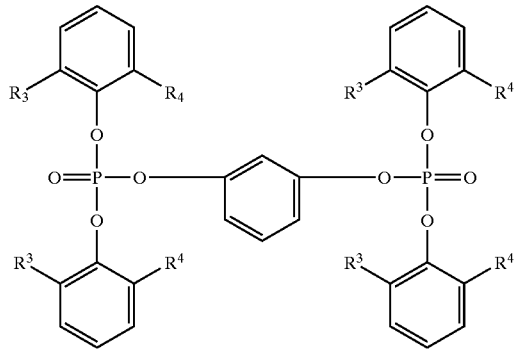

[in formula 4, each of $R^3$ and $R^4$ denotes hydrogen atom, alkyl groups such as methyl group or substituted alkyl group].

As to the polycaprolactones, from the viewpoint of the blur to be generated during the preservation of the image in a high temperature condition after the printing operation, an average molecular weight of polycaprolactone is preferably in the range of 2,000 to 100,000, and more preferably in the range of 10,000 to 70,000. If the average molecular weight thereof is less than 2,000, the blur of the printed image are liable to occur as time passes after the recording. On the other hand, if the average molecular weight thereof exceeds 100,000, there may arise a problem of production stability of polycaprolactone per se, and a problem of compatibility with respect to polycarbonate resin used in this invention.

Further, the polyester type plasticizer used in this invention means a plasticizer containing no polycaprolactone and having a small molecular weight. In this regard, diol adipate is particularly preferable as the polyester type plasticizer from the viewpoints of fingerprint resistance and plasticizer resistance or the like.

In addition, as described above, such various market requirements can be satisfied by further blending 5–50 parts by weight of another resin to 100 parts by weight of polycarbonate resin. In this case, the resin to be blended may preferably have a glass transition temperature of 60° C. or more. Among such resins, aromatic saturated polyester resin is particularly preferable.

The thermal transfer image receiving sheet of this invention can be obtained by forming the dye receptor layer on at least one surface of the substrate sheet. That is, the polycarbonate resin mentioned as above to which may contains at least one additive selected from the group consisting of phthalic acid type plasticizers, phosphoric ester type plasticizers, polycaprolactones and polyester type plasticizers are dissolved in an appropriate organic solvent to prepare a coating liquid. If desired, other additives such as release agent, crosslinking agent, curing agent, catalyst, ultraviolet absorbing agent, antioxidant, light stabilizing agent or the like are added. Thus prepared coating liquid is applied onto the substrate sheet by conventional coating methods such as a gravure printing, a screen printing, a reverse roll coating using a gravure plate, and then dried to form the dye receptor layer.

As the release agent, silicone oils and hardened product thereof are particularly preferable. When a hardened type silicone oil is added in an oil form into an ink for forming the receptor layer to prepare the ink which is well compatible to other materials constituting the dye receptor layer and then the ink is coated onto the substrate sheet and then hardened before or after the drying process, there can be obtained excellent characteristics in which releasing property and dyeing property are uniform in a micron-level and having no adhesion or sticking property. Preferred examples of such hardened type silicone oils may include addition polymerization silicones represented by the following formula 6 and carbinol-modified silicone oils represented by the following general formula 7;

FORMULA 6

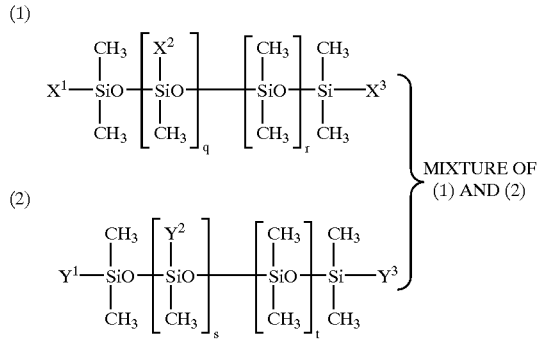

[in formula 6, $X^1$, $X^2$ and $X^3$ denote —$CH_3$ or —CH═$CH_2$, at least one of $X^1$, $X^2$ and $X^3$ denotes —CH═$CH_2$, $Y^1$, $Y^2$ and $Y^3$ denote hydrogen atom or —$CH_3$, at least one of $Y^1$, $Y^2$ and $Y^3$ denotes hydrogen atom, and each of q, r, s and t denotes integer]

FORMULA 7

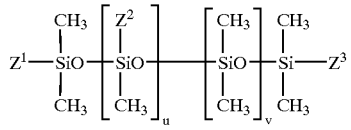

[in formula 7, $Z^1$, $Z^2$ and $Z^3$ denote —ROH or —$CH_3$, at least one of $Z^1$, $Z^2$ and $Z^3$ denotes —ROH, R denotes alkyl groups such as methyl group, ethyl group, propyl group or the like, and each of u and v denotes integer.

In this regard, as the carbinol-modified silicone oils, it is preferable to use a hardened product of carbinol-modified silicone oil which is hardened by reacting with isocyanate compounds. Further, for the purpose of improving the compatibility of the silicone oil with respect to the polycarbonate resin or the other materials of the dye receptor layer, it is preferable to use a silicone oil prepared by substituting a phenyl group for a part of methyl groups bonded to dimethyl siloxane chains.

The dye receptor layer to be formed as mentioned above may have an arbitrary thickness. However, the thickness is generally in the range of 1 to 50 $\mu$m. Further, the dye receptor layer may preferably formed as a continuous film. However, the dye receptor layer can be also formed as a discontinuous film by using resin emulsions or resin dispersed liquids.

The thermal transfer image receiving sheet of this invention can be applied to various applications such as thermal transfer sheet recordable by being thermally transferred, cards, a transparent type manuscript forming sheet or the like by appropriately selecting the material of the substrate sheet. A thermal transfer sheet to be used in conducting the thermal transfer method using the thermal transfer image receiving sheet of this invention is formed by providing a dye layer containing a sublimable dye on a base sheet such as a paper or a polyester film, and any conventional thermal transfer sheet per se can be employed to this invention as it is.

As means for applying heat energy in the thermal transfer method, any conventional means may be utilized. For example, a heat energy of about 5 to 100 mJ/$mm^2$ is given by means of recording device such as a thermal printer (e.g., Video Printer VY-170 or VY-VP10, produced by Hitachi Co., Ltd.; or Video Printer CP-700, produced by Mitsubishi Denki Co., Ltd.) while controlling the recording time, so as to sufficiently accomplish the initially aimed objects.

According to the present invention as described above, the dye receptor layer is mainly formed of specific polycarbonate resin, which is the polycarbonate resin of a random copolymer having a main chain which comprises the unit 1 represented by the formula 1 and the unit 2 represented by the formula 2, an amount ratio of the unit 1 being not more than 70 mol %, the polycarbonate resin having a glass transition temperature of not less than 125° C. and being dissolvable in a general solvent, or the polycarbonate resin of a homopolymer having a main chain which comprises the unit 2. As a result, the thermal transfer image receiving sheet of this invention enables to form a recorded image excellent in color density, sharpness and various toughness, especially in light resistance, and also enables to be easily manufactured by utilizing an ordinary coating device and by using a non-halogenated type organic solvents such as ketone type solvent, toluene type solvent, or a blended solvent thereof.

EXAMPLES

Hereinbelow, the present invention will be described in more detail with reference to Examples and Comparative Examples. In the description appearing hereinafter, terms "part(s)" and "%" represent "part(s) by weight" and "wt. %", respectively, unless otherwise noted specifically.

(Solubility in a General Solvent)

The following polycarbonate resins were dissolved at an amount of 20 wt % into a blended solvent of methyl ethyl ketone/toluene (blending ratio by weight: 1/1) to prepared resin solutions, then the solutions were shaken for 8 hours at a room temperature to evaluate the solubility of the respective resins. The results are set forth in Table 1.

(1) PC-1: Polycarbonate resin of a homopolymer composed of the unit 1 represented by the formula 1.

(2) PC-2: Polycarbonate resin of a random copolymer composed of 90 mol % of the unit 1 represented by the formula 1 and 10 mol % of the unit 2 represented by the formula 2.

(3) PC-3: Polycarbonate resin of a random copolymer composed of 80 mol % of the unit 1 represented by the formula 1 and 20 mol % of the unit 2 represented by the formula 2.

(4) PC-4: Polycarbonate resin of a random copolymer composed of 70 mol % of the unit 1 represented by the formula 1 and 30 mol % of the unit 2 represented by the formula 2.

(5) PC-5: Polycarbonate resin of a random copolymer composed of 60 mol % of the unit 1 represented by the formula 1 and 40 mol % of the unit 2 represented by the formula 2.

(6) PC-6: Polycarbonate resin of a random copolymer composed of 40 mol % of the unit 1 represented by the formula 1 and 60 mol % of the unit 2 represented by the formula 2.

(7) PC-7: Polycarbonate resin of a random copolymer composed of 20 mol % of the unit 1 represented by the formula 1 and 80 mol % of the unit 2 represented by the formula 2.

(8) PC-8: Polycarbonate resin of a homopolymer composed of the unit 2 represented by the formula 2.

FORMULA 1

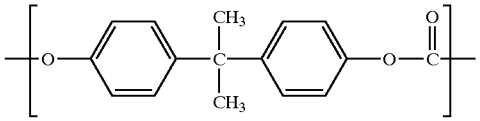

FORMULA 2

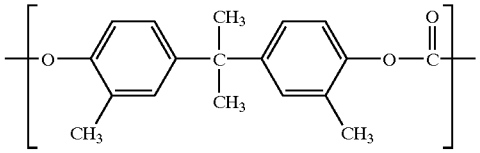

TABLE 1

| Sample No. | Viscosity Average Molecular Weight (Mv) | Tg (° C.) | Solubility |
|---|---|---|---|
| PC-1 | $2.80 \times 10^4$ | 149 | × (non-soluble) |
| PC-2 | $2.82 \times 10^4$ | — | × (turbid and separated) |
| PC-3 | $2.76 \times 10^4$ | — | × (turbid and separated) |
| PC-4 | $2.80 \times 10^4$ | — | ○ (transparent solution) |
| PC-5 | $2.81 \times 10^4$ | — | ○ (transparent solution) |
| PC-6 | $2.24 \times 10^4$ | 130.7 | ○ (transparent solution) |
| PC-7 | $2.08 \times 10^4$ | 127.1 | ○ (transparent solution) |
| PC-8 | $2.14 \times 10^4$ | 120.0 | ○ (transparent solution) |

Notes, all of the glass transition temperatures (Tg) listed in Table 1 and mentioned in this invention was measured in accordance with JIS (Japanese Industrial Standard) K7121 by means of a differential scanning calorimeter (DSC-50 produced by Shimazu Seisakusho Co., Ltd.).

Example 1

A synthetic paper (YUPO-FPG-150, thickness of 150 $\mu$m, manufactured by Ohji Yuka Co., Ltd.) was prepared as the substrate sheet. On the other hand, a coating liquid for a dye receptor layer having the following composition was prepared.

<Composition of Coating Liquid>

Polycarbonate resin (PC-6): 70 parts

Di-2-ethylhexyl phthalate (DOP) (freezing point: −55° C.): 30 parts

Addition polymerization type silicon oil represented by the following formula 8: 5.0 parts Platinum type curing catalyst (PL-50T, manufactured by Shinetsu Kagaku Kogyo Co., Ltd.) : 2.0 parts Methyl ethyl ketone/toluene (ratio by weight: 1/1): 400 parts

FORMULA 8

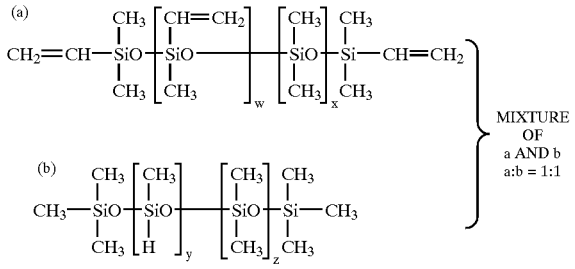

[In formula 8, each of w, x, y and z denotes integer, a weight ratio of the compound of formula a to the compound of formula b is 1:1. The compound of formula a has a molecular weight of about 7,000, a content in terms of an unit of vinyl group-modified siloxane is about 15 mol %, and about 30% of total methyl groups are substituted by phenyl groups. In contrast, the compound of formula b has a molecular weight of about 7,000, a content in terms of an unit of hydrogen-modified siloxane is about 15 mol %, and about 30% of total methyl groups are substituted by phenyl groups.]

Onto one surface of the synthetic paper, the coating liquid was applied in an amount of 4.0 g/m$^2$, (in a dried state) by means of a bar coater, followed by drying for one minute at a temperature of 120° C. to thereby form a thermal transfer image receiving sheet.

Example 2

The procedure for obtaining the thermal transfer image receiving sheet of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-6): 70 parts

Ethyl phthalyl ethyl glycolate (freezing point: 13° C.): 30 parts

Addition polymerization type silicon oil represented by the formula 8: 5.0 parts Platinum type curing catalyst (PL-50T, manufactured by Shinetsu Kagaku Kogyo Co., Ltd.): 2.0 parts Methyl ethyl ketone/toluene (ratio by weight: 1/1): 400 parts

Example 3

The procedure of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-6): 70 parts

Diphenyl phthalate (DPP) (melting point: 69° C.): 30 parts

Addition polymerization type silicon oil represented by the formula 8: 5.0 parts Platinum type curing catalyst (PL-50T, manufactured by Shinetsu Kagaku Kogyo Co., Ltd.): 2.0 parts Methyl ethyl ketone/toluene (ratio by weight: 1/1): 400 parts

Example 4

The procedure of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-6): 70 parts

Dicyclohexyl phthalate (DCHP) (melting point: 61° C.): 30 parts

Addition polymerization type silicon oil represented by the formula 8: 5.0 parts Platinum type curing catalyst (PL-50T, manufactured by Shinetsu Kagaku Kogyo Co., Ltd.): 2.0 parts Methyl ethyl ketone/toluene (ratio by weight: 1/1): 400 parts Example 5

The procedure of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-6): 60 parts

Dicyclohexyl phthalate (DCHP) (melting point: 61° C.): 40 parts

Addition polymerization type silicon oil represented by the formula 8: 5.0 parts Platinum type curing catalyst (PL-50T, manufactured by Shinetsu Kagaku Kogyo Co., Ltd.): 2.0 parts Methyl ethyl ketone/toluene (ratio by weight: 1/1): 400 parts Example 6

The procedure of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-6): 70 parts

Triphenyl phosphate (TPP, manufactured by Daihachi Kagaku Kogyo Co., Ltd.) (melting point: 48.5° C.) represented by the following formula 9: 30 parts Addition polymerization type silicon oil represented by the formula 8: 5.0 parts Platinum type curing catalyst (PL-50T, manufactured by Shinetsu Kagaku Kogyo Co., Ltd.): 2.0 parts Methyl ethyl ketone/toluene (ratio by weight: 1/1): 400 parts $(O)P(OC_6H_5)_3$ FORMULA 9

Example 7

The procedure of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-6): 70 parts

Tris(2,6-dimethyl phenyl) phosphate (PX-130, manufactured by Daihachi Kagaku Kogyo Co., Ltd.) (melting point:136–138° C.) represented by the following formula 10.: 30 parts Addition polymerization type silicon oil represented by the formula 8: 5.0 parts Platinum type curing catalyst (PL-50T, manufactured by Shinetsu Kagaku Kogyo Co., Ltd.): 2.0 parts Methyl ethyl ketone/toluene (ratio by weight: 1/1): 400 parts

FORMULA 10

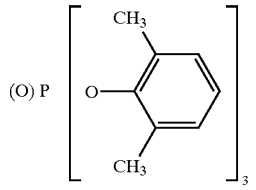

Example 8

The procedure for obtaining the thermal transfer image receiving sheet of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-6): 70 parts

Tetra-phenyl resorcinol di-phosphate (freezing point: −13° C.) represented by the following formula 11.: 30 parts Addition polymerization type silicon oil represented by the formula 8: 5.0 parts Platinum type curing catalyst (PL-50T, manufactured by Shinetsu Kagaku Kogyo Co., Ltd.): 2.0 parts Methyl ethyl ketone/toluene (ratio by weight: 1/1): 400 parts

FORMULA 11

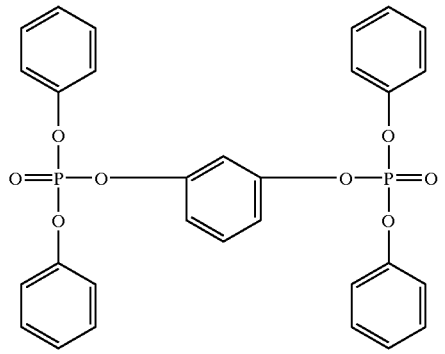

Example 9

The procedure for obtaining the thermal transfer image receiving sheet of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-6): 70 parts

Tetrakis(2,6-xylenol resorcinol) di-phosphate (melting point: 96° C.) represented by the following formula 12.: 30 parts Addition polymerization type silicon oil represented by the formula 8: 5.0 parts Platinum type curing catalyst (PL-50T, manufactured by Shinetsu Kagaku Kogyo Co., Ltd.): 2.0 parts Methyl ethyl ketone/toluene (ratio by weight: 1/1): 400 parts

FORMULA 12

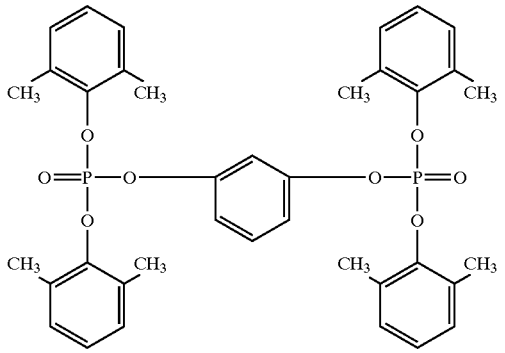

Example 10

The procedure for obtaining the thermal transfer image receiving sheet of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-6): 60 parts

Triphenyl phosphate (TPP, manufactured by Daihachi Kagaku Kogyo Co., Ltd.) (melting point: 48.5° C.) represented by the formula 9: 40 parts Addition polymerization type silicon oil represented by the formula 8: 5.0 parts Platinum type curing catalyst (PL-50T, manufactured by Shinetsu Kagaku Kogyo Co., Ltd.): 2.0 parts Methyl ethyl ketone/toluene (ratio by weight: 1/1): 400 parts Example 11

The procedure for obtaining the thermal transfer image receiving sheet of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-6): 60 parts

Tris(2,6-dimethyl phenyl)phosphate (PX-130, manufactured by Daihachi Kagaku Kogyo Co., Ltd.) (melting point: 136–138° C.) represented by the formula 10.: 40 parts Addition polymerization type silicon oil represented by the formula 8: 5.0 parts Platinum type curing catalyst (PL-50T, manufactured by Shinetsu Kagaku Kogyo Co., Ltd.): 2.0 parts Methyl ethyl ketone/toluene (ratio by weight: 1/1): 400 parts Example 12

The procedure for obtaining the thermal transfer image receiving sheet of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-6): 60 parts

Polycaprolactone (PLACCEL H4, manufactured by Daicel Chemical Industries Ltd.) (molecular weight: $4\times10^4$, melting point: 60° C.): 40 parts Addition polymerization type silicon oil represented by the formula 8: 5.0 parts Platinum type curing catalyst (PL-50T, manufactured by Shinetsu Kagaku Kogyo Co., Ltd.): 2.0 parts Methyl ethyl ketone/toluene (ratio by weight: 1/1): 400 parts Example 13

The procedure for obtaining the thermal transfer image receiving sheet of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-6): 60 parts

Polycaprolactone (PLACCEL H4, manufactured by Daicel Chemical Industries Ltd.) (molecular weight: $7\times10^4$–$10\times10^4$, melting point: 60° C.): 40 parts Addition polymerization type silicon oil represented by the formula 8: 5.0 parts Platinum type curing catalyst (PL-50T, manufactured by Shinetsu Kagaku Kogyo Co., Ltd.): 2.0 parts Methyl ethyl ketone/toluene (ratio by weight: 1/1): 400 parts Example 14

The procedure for obtaining the thermal transfer image receiving sheet of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-4): 60 parts

Dicyclohexyl phthalate (DCHP) (melting point: 61° C.): 40 parts

Addition polymerization type silicon oil represented by the formula 8: 5.0 parts Platinum type curing catalyst (PL-50T, manufactured by Shinetsu Kagaku Kogyo Co., Ltd.): 2.0 parts Methyl ethyl ketone/toluene (ratio by weight: 1/1): 400 parts Example 15

The procedure for obtaining the thermal transfer image receiving sheet of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-6): 60 parts

Polycaprolactone (PLACCEL 240, manufactured by Daicel Chemical Industries Ltd.) (molecular weight: 4,000, melting point: 55–58° C.): 40 parts Addition polymerization type silicon oil represented by the formula 8: 5.0 parts Platinum type curing catalyst (PL-50T, manufactured by Shinetsu Kagaku Kogyo Co., Ltd.): 2.0 parts Methyl ethyl ketone/toluene (ratio by weight: 1/1): 400 parts Example 16

The procedure for obtaining the thermal transfer image receiving sheet of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-6): 60 parts

Polycaprolactone (PLACCEL 240, manufactured by Daicel Chemical Industries Ltd.) (molecular weight: 4,000, melting point: 55–58° C.): 40 parts Carbinol-modified silicon oil represented by the following formula 13: 5.0 parts XDI-biuret form of Isocyanate compound (TAKENATE XA-14, manufactured by Takeda Yakuhin Kogyo Co., Ltd.): 10.0 parts Di-n-butyl tin dilaurate (STANN BL manufactured by Sankyo Yuki Gosei Co., Ltd.): 0.1 part Methyl ethyl ketone/toluene (ratio by weight: 1/1): 400 parts

FORMULA 13

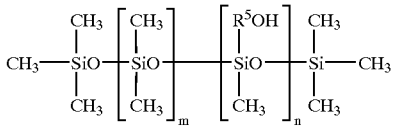

[In formula 13, a molecular weight is about 2,000 and an OH valence of about 140 mg-KOH/g, and about 20% of total methyl groups are substituted by phenyl groups. $R^5$ denotes alkyl groups such as methyl group, ethyl group or the like, and each of m and n denotes integer.]

Example 17

The procedure for obtaining the thermal transfer image receiving sheet of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-6): 60 parts

Polycaprolactone (PLACCEL H4, manufactured by Daicel Chemical Industries Ltd.) (molecular weight: $4\times10^4$, melting point: 60° C.): 40 parts Carbinol-modified silicon oil represented by the formula 13: 5.0 parts XDI-biuret form of Isocyanate compound (TAKENATE XA-14, manufactured by Takeda Yakuhin Kogyo Co., Ltd.): 10.0 parts Di-n-butyl tin dilaurate (STANN BL manufactured by Sankyo Yuki Gosei Co., Ltd.): 0.1 part Methyl ethyl ketone/toluene (ratio by weight: 1/1): 400 parts Example 18

The procedure for obtaining the thermal transfer image receiving sheet of Example 1 was repeated except that a coating liquid having the following composition was used in place of the coating liquid used in Example 1, whereby a thermal transfer image receiving sheet was obtained.

<Composition of coating liquid>

Polycarbonate resin (PC-7): 60 parts

Polycaprolactone (PLACCEL H7, manufactured by Daicel Chemical Industries Ltd.) (molecular weight: $7\times10^4$–$10\times10^4$, melting point: 60° C.): 40 parts Carbinol-modified silicon oil represented by the formula 13: 5.0 parts XDI-biuret form of Isocyanate compound (TAKENATE XA-14, manufactured by Takeda Yakuhin Kogyo Co., Ltd.): 10.0 parts Di-n-butyl tin dilaurate (STANN BL manufactured by Sankyo Yuki Gosei Co., Ltd.): 0.1 part Methyl ethyl ketone/toluene (ratio by weight: 1/1): 400 parts Example 19

The procedure for obtaining the thermal transfer image receiving sheet of Example 1 was repeated except that a coating liquid having the following composition was used in place of the coating liquid used in Example 1, whereby a thermal transfer image receiving sheet was obtained.

<Composition of coating Liquid>

Polycarbonate resin (PC-8): 70 parts

Dicyclohexyl phthalate (DCHP) (melting point: 61° C.): 30 parts

Addition polymerization type silicon oil represented by the formula 8: 5.0 parts Platinum type curing catalyst (PL-50T, manufactured by Shinetsu Kagaku Kogyo Co., Ltd.): 2.0 parts Methyl ethyl ketone/toluene (ratio by weight: 1/1): 400 parts Example 20

The procedure for obtaining the thermal transfer image receiving sheet of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-4): 80 parts

Aromatic saturated polyester resin (VYLON 200, manufactured by Toyo boseki Co., Ltd): 20 parts Polycaprolactone (PLACCEL H7, manufactured by Daicel Chemical Industries Ltd.) (molecular weight: $7\times10^4$–$10\times10^4$, melting point: 60° C.): 40 parts Carbinol-modified silicon oil represented by the formula 13: 5.0 parts XDI-biuret form of Isocyanate compound (TAKENATE XA-14, manufactured by Takeda Yakuhin Kogyo Co., Ltd.): 10.0 parts Di-n-butyl tin dilaurate (STANN BL manufactured by Sankyo Yuki Gosei Co., Ltd.): 0.1 part Methyl ethyl ketone/toluene (ratio by weight: 1/1): 560 parts Example 21

The procedure for obtaining the thermal transfer image receiving sheet of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-6): 80 parts

Aromatic saturated polyester resin (VYLON 200, manufactured by Toyo boseki Co., Ltd): 10 parts Polycaprolactone (PLACCEL H7, manufactured by Daicel Chemical Industries Ltd.) (molecular weight: $7\times10^4$–$10\times10^4$, melting point: 60° C.): 40 parts Carbinol-modified silicon oil represented by the formula 13: 5.0 parts XDI-biuret form of Isocyanate compound (TAKENATE XA-14, manufactured by Takeda Yakuhin Kogyo Co., Ltd.): 10.0 parts Di-n-butyl tin dilaurate (STANN BL manufactured by Sankyo Yuki Gosei Co., Ltd.): 0.1 part Methyl ethyl ketone/toluene (ratio by weight: 1/1): 520 parts Example 22

The procedure for obtaining the thermal transfer image receiving sheet of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-4): 80 parts

Aromatic saturated polyester resin (VYLON 200, manufactured by Toyo boseki Co., Ltd): 20 parts Polycaprolactone (PLACCEL H4, manufactured by Daicel Chemical Industries Ltd.) (molecular weight: $4\times10^4$, melting point: 60° C.): 20 parts Poly 1,3-butanediol adipate (polyester type plasticizer) (BAA-15, manufactured by Daihachi Kagaku Kogyo Co.,. Ltd.): 20 parts Carbinol-modified silicon oil represented by the formula 13: 5.0 parts XDI-biuret form of Isocyanate compound (TAKENATE XA-14, manufactured by Takeda Yakuhin Kogyo Co., Ltd.): 10.0 parts Di-n-butyl tin dilaurate (STANN BL manufactured by Sankyo Yuki Gosei Co., Ltd.): 0.1 part Methyl ethyl ketone/toluene (ratio by weight: 1/1): 480 parts Comparative Example 1

The procedure for obtaining the thermal transfer image receiving sheet of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-6): 100 parts

Addition polymerization type silicon oil represented by the formula 8: 5.0 parts Platinum type curing catalyst (PL-50T, manufactured by Shinetsu Kagaku Kogyo Co., Ltd.): 2.0 parts Methyl ethyl ketone/toluene (ratio by weight: 1/1): 400 parts Comparative Example 2

The procedure for obtaining the thermal transfer image receiving sheet of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-1): 100 parts

Addition polymerization type silicon oil represented by the formula 8: 5.0 parts Platinum type curing catalyst (PL-50T, manufactured by Shinetsu Kagaku Kogyo Co., Ltd.): 2.0 parts Trichloromethane: 400 parts Comparative Example 3

The procedure for obtaining the thermal transfer image receiving sheet of Example 1 was repeated except that a coating liquid having the following composition was used in place of the coating liquid used in Example 1, whereby a thermal transfer image receiving sheet was obtained.

<Composition of Coating Liquid>

Polycarbonate resin (PC-8): 100 parts

Addition polymerization type silicon oil represented by the formula 8: 5.0 parts Platinum type curing catalyst (PL-50T, manufactured by Shinetsu Kagaku Kogyo Co., Ltd.): 2.0 parts Methyl ethyl ketone/toluene (ratio by weight: 1/1): 400 parts With respect to thus obtained thermal transfer image receiving sheets of Examples and Comparative Examples, the following various evaluation tests were conducted to examine performances of the sheets.

(Thermal Transfer Test)

Thermal transfer films (PK700, commercial products) for use in a video printer (CP-700, manufactured by Mitsubishi Denki Co., Ltd.) were prepared. With respect to each colors of Y (yellow), M (magenta) and C (cyan), the thermal transfer sheets were superposed on the thermal transfer image receiving sheets of the present invention and Comparative Examples so that the dye layer and the receptor layer faced to each other, and they were subjected to a thermal transfer printing while applying a thermal head to a back surface of the thermal transfer film under the following conditions to evaluate various characteristics.

<Printing Conditions>

Thermal head: KGT-217-12MPL20 (available from Kyocera Co., Ltd.)

Average resistance of a heating body: 3195 (Ω)

Printing density in main scanning direction: 300 dpi

Printing density in sub-scanning direction: 300 dpi

Applied electric power: 0.12 (w/dot)

1 line cycle: 5 (msec.)

Print-starting temperature: 40° C.

Gradation controlling method: A multi-pulse type test printer capable of varying a number of divided pulses in a range of 0 to 255 was used, and the divided pulse has a pulse-length corresponding to a length obtained by equally dividing one line cycle into 256 sections. A duty ratio of each of the divided pulse was fixed to 60%, and the gradation of an image was controlled in 16 steps from 0 step to 15th step by increasing the number of the pulses per every step, i.e., the number of the pulses were changed from 0 to 255 by step-wisely increasing 17 pulses per each step in accordance with the gradation of the image. For example, the pulse number per unit line cycle is 0 for 0 step, 17 for 1 step, 34 for 2 step,—and so on.

(Sharpness (Clarity) )

A thermal transfer recording was conducted under the printing conditions described above by using the thermal transfer image receiving sheets of Examples, Comparative Examples and the thermal transfer films described above. Then, the sharpness of thus obtained recorded images were visually evaluated in accordance with the following evaluation criteria.

○: Sufficient sharpness and density could be obtained, and a smooth gradation could be obtained in a range from a low density portion to a high density portion of the image.

×: Sharpness was poor, and the gradation of the low density portion of the recorded image was poor.

(Heat Resistance Test Prior to Printing Procedure)

Two sheets of the respective thermal transfer image receiving sheets of Examples and Comparative Examples were prepared. One sheet was preserved in a normal temperature atmosphere for 100 hours, while the other sheet was preserved in an oven of 60° C. for 100 hours. Thereafter, each of the thermal transfer image receiving sheets was subjected to the printing procedure by using the thermal transfer film as mentioned before under the printing conditions described above and then printing the color gradations of Y, M and C.

With respect to the thus obtained printed sheets, optical reflection densities in every step were measured by means of an optical densitometer (Macbeth RD-918, available from Macbeth Co., Ltd.). With respect to each of the measured optical reflection densities for every colors or steps, the measured values of the optical reflection densities of the printed sheets obtained from the thermal transfer image receiving sheets preserved in the normal temperature atmosphere were assumed to be [OD]0, while the measured values of the optical reflection densities of the printed sheets obtained from the thermal transfer image receiving sheets preserved in the oven of 60° C. for 100 hours were assumed to be [OD]1. Then, with respect to each of the corresponding to colors or steps, a rate of change of γ characteristic due to the heat resistance test prior to printing procedure was calculated in accordance with the following equation:

$$\text{Rate of change}=([OD]1-[OD]0)\times 100/[OD]0$$

With respect to the rate of change showing a largest value in the respective colors and steps, the rate of change was evaluated on the basis of the following evaluation criteria as a stability of the thermal transfer image receiving sheet when preserved in a high temperature condition prior to the printing procedure.

○: The rate of change was less than ±10%.

Δ: The rate of change was ±10% or more and less than ±20%.

×: The rate of change was ±20% or more.

(Light Resistance Test)

A thermal transfer recording was conducted under the printing conditions described above by using the thermal transfer image receiving sheets of the Examples and the Comparative Examples and the thermal transfer films described above. Then, with respect to Cy color printed in the thus obtained recorded images, a light resistance test was conducted under the following conditions.

Irradiation tester: Ci35, available from Atlas Co., Ltd.

Light source: xenon lamp

Filter: Inside—IR filter, Outside—soda-lime glass

Black panel temperature: 45° C.

Irradiation strength: 1.2 ($W/m^2$), which was a measured value at 420 (nm)

Irradiation energy: 200($KJ/m^2$), which was an integrated value at 420 (nm)

With respect to a step of which the optical reflection density was close to 1.0, the change of the optical density before and after the irradiation was measured. Then, a survival ratio was calculated in accordance with the following equation.

$$\text{Survival ratio (\%)}=([\text{Optical reflection density after irradiation}]/[\text{Optical reflection density before irradiation}])\times 100$$

The light resistances of the respective thermal transfer image receiving sheets were evaluated in accordance with the following evaluation criteria.

○: The survival ratio was 80% or more.

Δ: The survival ratio was 70% or more and less than 80%.

×: The survival ratio was less than 70%.

(Heat Resistance Test After Printing Procedure)

A thermal transfer recording was conducted under the printing conditions described above by using the thermal transfer image receiving sheets of the Examples and the Comparative Examples and the thermal transfer films described above. Then, the printed sheets were preserved in an oven of 60° C. for 100 hours. Thereafter, the blur occurring in the respective printed sheets were observed by means of a magnifying glass having a magnification of 25, and the heat resistance of the respective printed sheets after the printing procedure was evaluated on the basis of the following evaluation criteria.

○: A remarkable change in dot size of the thermal head was not observed.

Δ: Though diffusion of the dot was observed, an apparent blur was not found through a visual observation.

×: The coloring material remarkably diffused to a non-printed portion, apparent blur were found even through the visual observation.

(Fingerprint Resistance)

A thermal transfer recording was conducted under the printing conditions described above by using the thermal transfer image receiving sheets of the Examples and the Comparative Examples and the thermal transfer films described above. A finger print was formed onto a surface of the printed sheet by pressing a finger thereon. Then, the fingerprint-formed sheets were held at a room temperature for three days. Thereafter, a degree of change of the fingerprint-formed portion of the respective printed sheets were visually observed, and the fingerprint resistance of the respective printed sheets was evaluated on the basis of the following evaluation criteria.

○: A difference between the finger-printed portion and non-finger-printed portion was hardly observed.

Δ: Density change and discoloration were observed in the finger-printed portion.

×: Density change and discoloration were observed in the finger-printed portion, and white drop-out and coagulation of the dye were apparently observed.

(Plasticizer Resistance)

A thermal transfer recording was conducted under the printing conditions described above by using the thermal transfer image receiving sheets of Examples, Comparative Examples and the thermal transfer films described above. Then, a specified portion on a surface of the printed sheet was softly rubbed two or three times by using a plastic eraser (commercially available).

Thereafter, a degree of density change of the rubbed portion was visually observed, and the plasticizer resistance of the respective sheets was evaluated on the basis of the following evaluation criteria.

○: Density change was hardly observed.

Δ: A Density change was apparently observed.

×: Density was greatly changed, and in particular, the white drop-out occurred so as to range from a low-density portion to an intermediate-density portion.

The results of the evaluations are summarized in Table 2 listed hereunder. Notes, the overall evaluations indicated in Table 2 are established by taking all of the various evaluation items i.e., sharpness, heat resistance test prior to printing procedure, light resistance test, heat resistance test after printing procedure, fingerprint resistance, plasticizer resistance into consideration on the basis of the following evaluation criteria.

○: All of the six evaluation items contains a degree of ○.

Δ: AAmong all of six evaluation items, one to three of the items contain a degree of Δ, and two or less of the items contain a degree of ×. In case of the items containing three degrees of Δ, remaining items contain one or less of a degree of ×.

×: Among all of six evaluation items, the items contain at least three degrees of ×.

TABLE 2(1)

| Example No. | Sharpness | Heat Resistant Test Before Printing | Light Resistant Test | Heat Resistant Test After Printing |
|---|---|---|---|---|
| Example 1 | ○ | × | ○ | × |
| Example 2 | ○ | × | ○ | ○ |
| Example 3 | ○ | ○ | ○ | ○ |
| Example 4 | ○ | ○ | ○ | ○ |
| Example 5 | ○ | ○ | ○ | ○ |
| Example 6 | ○ | × | ○ | ○ |
| Example 7 | ○ | ○ | ○ | ○ |
| Example 8 | ○ | ○ | Δ | ○ |
| Example 9 | ○ | ○ | ○ | ○ |
| Example 10 | ○ | × | ○ | Δ |
| Example 11 | ○ | ○ | ○ | ○ |
| Example 12 | ○ | ○ | ○ | Δ |
| Example 13 | ○ | ○ | ○ | Δ |
| Example 14 | ○ | ○ | ○ | ○ |
| Example 15 | ○ | Δ | ○ | × |
| Example 16 | ○ | ○ | ○ | Δ |
| Example 17 | ○ | ○ | ○ | Δ |
| Example 18 | ○ | ○ | ○ | Δ |
| Example 19 | ○ | ○ | ○ | ○ |
| Example 20 | ○ | ○ | ○ | ○ |
| Example 21 | ○ | ○ | ○ | ○ |
| Example 22 | ○ | ○ | ○ | ○ |
| Comparative Example 1 | × | ○ | ○ | ○ |
| Comparative Example 2 | × | ○ | ○ | ○ |
| Comparative Example 3 | × | ○ | ○ | ○ |

TABLE 2 (2)

| Example No. | Fingerprint Resistance | Plasticizer Resistance | Overall Evaluation |
|---|---|---|---|
| Example 1 | | | |
| Example 2 | Δ | Δ | Δ |
| Example 3 | Δ | Δ | Δ |
| Example 4 | Δ | Δ | Δ |
| Example 5 | Δ | Δ | Δ |

TABLE 2 (2)-continued

| Example No. | Fingerprint Resistance | Plasticizer Resistance | Overall Evaluation |
|---|---|---|---|
| Example 6 | Δ | Δ | Δ |
| Example 7 | Δ | Δ | Δ |
| Example 8 | Δ | Δ | Δ |
| Example 9 | Δ | Δ | Δ |
| Example 10 | Δ | Δ | Δ |
| Example 11 | Δ | Δ | Δ |
| Example 12 | ○ | ○ | Δ |
| Example 13 | ○ | ○ | Δ |
| Example 14 | Δ | Δ | Δ |
| Example 15 | Δ | ○ | Δ |
| Example 16 | Δ | ○ | Δ |
| Example 17 | ○ | ○ | Δ |
| Example 18 | ○ | ○ | Δ |
| Example 19 | Δ | Δ | Δ |
| Example 20 | ○ | ○ | ○ |
| Example 21 | ○ | ○ | ○ |
| Example 22 | ○ | ○ | ○ |
| Comparative Example 1 | × | × | × |
| Comparative Example 2 | × | × | × |
| Comparative Example 3 | × | × | × |

The results as shown in Table 2 were obtained. In this regard, among the respective coating liquids for forming the dye receptor layers of the Examples and the Comparative Examples, the coating liquid for the Comparative Example 2 was prepared by using the homopolymer composed of the unit 1 represented by the formula 1 which was derived from bisphenol A, so that the homopolymer could not be dissolved into non-halogenated organic solvents such as ketone type solvent, toluene type solvent or blended solvent thereof. Therefore, the polycarbonate resin of the Comparative Example 2 was obliged to be dissolved into chlorinated solvents such as tri-chloromethane having a strong toxicity.

What is claimed is:

1. A thermal transfer image receiving sheet comprising a substrate sheet and a dye receptor layer disposed on at least one surface of said substrate sheet, wherein said dye receptor layer comprises polycarbonate resin of a random copolymer having a main chain which comprises, as essential units, an unit 1 represented by the following formula 1 and an unit 2 represented by the following formula 2, an amount ratio of the unit 1 being not more than 70 mol % based on a total amount of the unit 1 and the unit 2, said polycarbonate resin having a glass transition temperature of not less than 125° C. and being dissolvable in a general solvent:

FORMULA 1 (UNIT 1)

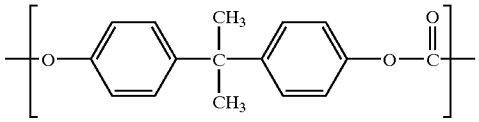

FORMULA 2 (UNIT 2)

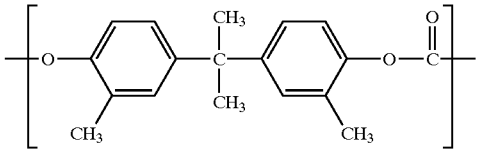

said dye receptor layer further comprises at least one additive selected from the group consisting of phthalic acid type plasticizers, phosphoric ester type plasticizers, polycaprolactones and polyester plasticizers.

2. A thermal transfer image receiving sheet according to claim 1, wherein said general solvent is a non-halogenated organic solvent.

3. A thermal transfer image receiving sheet according to claim 1, wherein said additive has a melting point or freezing point of not less than 60° C.

4. A thermal transfer image receiving sheet according to claim 1, wherein said phthalic acid type plasticizer is dicyclohexyl phthalate.

5. A thermal transfer image receiving sheet according to claim 1, wherein said phosphoric ester type plasticizer is at least one compound selected from the group consisting of non-halogenated phosphoric esters and non-halogenated condensed phosphoric esters.

6. A thermal transfer image receiving sheet according to claim 5, wherein said non-halogenated phosphoric ester is a compound represented by the following formula 3:

FORMULA 3

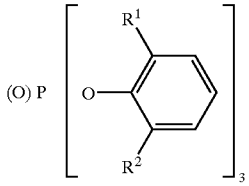

in formula 3, each of $R^1$ and $R^2$ denotes hydrogen atom, alkyl group or substituted alkyl group.

7. A thermal transfer image receiving sheet according to claim 5, wherein said non-halogenated condensed phosphoric ester is a compound represented by the following formula 4:

FORMULA 4

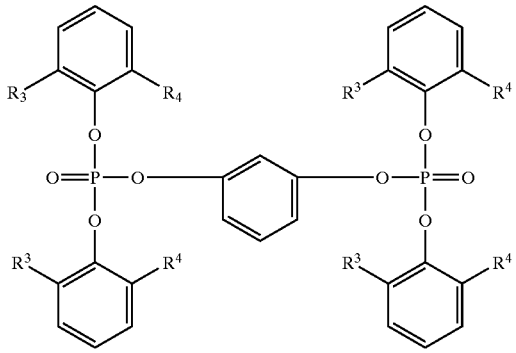

in formula 4, each of $R^3$ and $R^4$ denotes hydrogen atom, alkyl group or substituted alkyl group.

8. A thermal transfer image receiving sheet according to claim 1, wherein said dye receptor layer further comprises aromatic saturated polyester resin.

9. A thermal transfer image receiving sheet according to claim 1, wherein said dye receptor layer further comprises at least one releasing agent selected from the group consisting of silicone oils and hardened products of said silicone oils.

10. A thermal transfer image receiving sheet according to claim 9, wherein said hardened product of silicone oil is at least one compound selected from the group consisting of hardened products of addition polymerization silicones and hardened products of carbinol-modified silicones hardened with isocyanate compounds.

11. A thermal transfer image receiving sheet according to claim 1, wherein said dye receptor layer further comprises at least one additive selected from the group consisting of phthalic acid type plasticizers, phosphoric ester type plasticizers, polycaprolactones and polyester plasticizers, and further comprises at least one releasing agent selected from the group consisting of hardened products of silicone oils.

12. A thermal transfer image receiving sheet according to claim 11, wherein said hardened product of silicone oil is at least one compound selected from the group consisting of hardened products of addition polymerization silicones and hardened products of carbinol-modified silicones hardened with isocyanate compounds.

* * * * *